US008974023B2

(12) United States Patent
Li et al.

(10) Patent No.: US 8,974,023 B2
(45) Date of Patent: Mar. 10, 2015

(54) METHOD AND DEVICE FOR CONTROLLING INKJET PRINTING POSITION

(75) Inventors: Zhenhua Li, Beijing (CN); Zhihong Liu, Beijing (CN)

(73) Assignees: Peking University Founder Group Co., Ltd., Beijing (CN); Peking University, Beijing (CN); Beijing Founder Electronics Co., Ltd., Beijing (CN)

( * ) Notice: Subject to any disclaimer, the term of this patent is extended or adjusted under 35 U.S.C. 154(b) by 0 days.

(21) Appl. No.: 13/882,471

(22) PCT Filed: Oct. 27, 2011

(86) PCT No.: PCT/CN2011/081411

§ 371 (c)(1),
(2), (4) Date: Aug. 22, 2013

(87) PCT Pub. No.: WO2012/055365

PCT Pub. Date: May 3, 2012

(65) Prior Publication Data

US 2013/0321503 A1 Dec. 5, 2013

(30) Foreign Application Priority Data

Oct. 29, 2010 (CN) ..... 2010 1 0531979

(51) Int. Cl.
*B41J 29/38* (2006.01)
*B41J 2/045* (2006.01)
*B41J 11/00* (2006.01)

(52) U.S. Cl.
CPC ..... *B41J 2/04501* (2013.01); *B41J 11/008* (2013.01)
USPC ..... 347/10; 347/5

(58) Field of Classification Search
None
See application file for complete search history.

(56) References Cited

U.S. PATENT DOCUMENTS 6,068,362 A * 5/2000 Dunand et al. ..... 347/16

FOREIGN PATENT DOCUMENTS

| | | | |
|---|---|---|---|
| CN | 1872552 | A | 12/2006 |
| CN | 101628511 | A | 1/2010 |
| CN | 201538103 | U | 8/2010 |
| JP | H 05-11525 | A | 1/1993 |
| JP | H 05-83490 | A | 4/1993 |
| JP | 2003-63078 | A | 3/2003 |
| JP | 2003-334979 | A | 11/2003 |

(Continued)

OTHER PUBLICATIONS

International Search Report mailed Feb. 9, 2012, issued from the ISA of the State Intellectual Property Office P.R. China in International Application No. PCT/CN2011/081411 (6 pages).

(Continued)

*Primary Examiner* — Geoffrey Mruk
(74) *Attorney, Agent, or Firm* — Finnegan, Henderson, Farabow, Garrett & Dunner, LLP

(57) ABSTRACT

This application discloses a method for controlling jet printing positions, including: detecting a color code of an inputted paper by a color code sensor, and outputting a pulse signal when the color code is detected; configuring an expectation window where the pulse signal is expected to be generated; initiating jet printing after a predetermined delay period when the pulse signal is detected in the expectation window; and initiating jet printing after correction when no pulse signal is detected in the expectation window or the pulse signal is detected outside the expectation window. The method may improve the quality of jet printing.

9 Claims, 2 Drawing Sheets

(56) References Cited

FOREIGN PATENT DOCUMENTS

| | | | |
|---|---|---|---|
| JP | 2004-142199 | A | 5/2004 |
| JP | 2005-246123 | A | 9/2005 |
| JP | 2009-248502 | A | 10/2009 |

OTHER PUBLICATIONS

PCT International Preliminary Report on Patentability (Chapter I) dated Apr. 30, 2013, issued in International Application No. PCT/CN2011/081411 (10 pages).

PCT Written Opinion of the International Searching Authority mailed Feb. 9, 2012, in International Application No. PCT/CN2011/081411 (8 pages).

Chinese Office Action dated Jun. 5, 2013, issued in Chinese Application No. 201010531979.7 (5 pages).

Chinese Notification of Grant dated Jan. 26, 2014, issued in Chinese Application No. 201010531979.7 (1 page).

Japanese Office Action dated May 27, 2014, issued in Japanese Application No. 2013-535269 (3 pages).

* cited by examiner

METHOD AND DEVICE FOR CONTROLLING INKJET PRINTING POSITION

This application is a national stage application of International Application No. PCT/CN2011/081411, filed on Oct. 27, 2011, which claims priority to Chinese Patent Application No. 201010531979.7, filed Oct. 29, 2010, the entire content of both of which are incorporated herein by reference.

TECHNICAL FIELD

The present application relates to the field of printing, in particular, to a method and a device for controlling jet printing positions.

BACKGROUND

Various techniques of high-speed jet printing have been widely used in the printing industry. One of the main goals of the applications of these techniques is, under the control of computers, to jet print variable labels, bills, bar codes on continuous papers having color blocks in a fixed interval. In a high-speed jet control system, according to the positions of color blocks, positions of jet printing are often controlled using the following two methods.

I. High Level Software Based Correction Method

A color code sensor detects the color blocks printed on continuous papers and the color blocks are used as reference signals for printing. An encoder outputs pulse signals which are in synchronization with paper motion. Then, the color block interval on the continuous papers can be calculated and the information is delivered to high level control software. After detecting a first color code, the printing unit continuously prints the received image data according to the pulse signals output by the encoder. The software adjusts blank data between valid image data according to the received information of color block spacing, so as to control the printing positions. This method can be easily implemented. When color block spaces are relatively constant, the printing positions of images are generally accurate. However, when difference among color block spaces are relatively large or a color code is undetected during the process of detecting, this method of control of printing positions may be slow to adjust to the correct printing positions. Thus, the printing positions may be erroneous and many defective printing products may be produced.

II. Hardware Based Simple Control Method

The control software transfers the valid image data to be printed to a print control unit. The control software also uses hardware to control the printing positions. A color code sensor detects the color blocks printed on continuous papers and the color blocks are used as reference signals for printing. An encoder outputs pulse signals which are in synchronization with paper motion. After a color code signal is detected, an jet control system delays N encoder pulses according to software configurations so as to start to print a page of image data. After another color code signal is detected, N encoder pulses are delayed again to print a next page of image data. These steps repeat. This method can reduce the burden on the software. Even if the color block spaces vary a bit, the printing can be performed accurately according to the real-time detected color code signals. However, when there are interferences to color code signals or a color code is undetected, there may be false printing or missed printing so that some defective printing products are produced.

SUMMARY

The present application provides a method and a device for controlling positions of jet printing to solve the problem of false printing or missed printing.

According to an embodiment of the present application, a method for controlling positions of jet printing is provided. The method may comprise: detecting a color code of an inputted paper by a color code sensor, and outputting a pulse signal when the color code is detected, configuring an expectation window where the pulse signal is expected to be generated, and initiating jet printing after a predetermined delay period when the pulse signal is detected in the expectation window and initiating jet printing after correction when no pulse signal is detected in the expectation window or the pulse signal is detected outside the expectation window.

According to another embodiment of the present application, a device for controlling positions of jet printing is provided. The device may comprise: a color code sensor for detecting color codes of inputted papers and outputting a pulse signal when a color code is detected, a configuring module for configuring an expectation window where the pulse signal is expected to be generated, and a printing module for initiating jet printing after a predetermined delay period when a pulse signal is detected in the expectation window and for initiating the jet printing after correction when no pulse signal is detected in the expectation window or a pulse signal is detected outside the expectation window.

In the method and the device for controlling positions of jet printing according to the embodiments of the present application, an expectation window where a pulse signal should be generated is configured. Therefore, the problem of false printing or missed printing may be solved and the quality of jet printing may be improved.

BRIEF DESCRIPTION OF THE DRAWING

The drawings described herein are used to provide a further understanding to the present application and constitute a part of this specification. Exemplary embodiments of the present application and their descriptions serve to explain the present application and do not constitute improper limitation on the present application. In the drawings.

DETAILED DESCRIPTION

Hereinafter, the present application will be explained in detail with reference to the accompanying drawings in connection with the embodiments.

Figure 1:
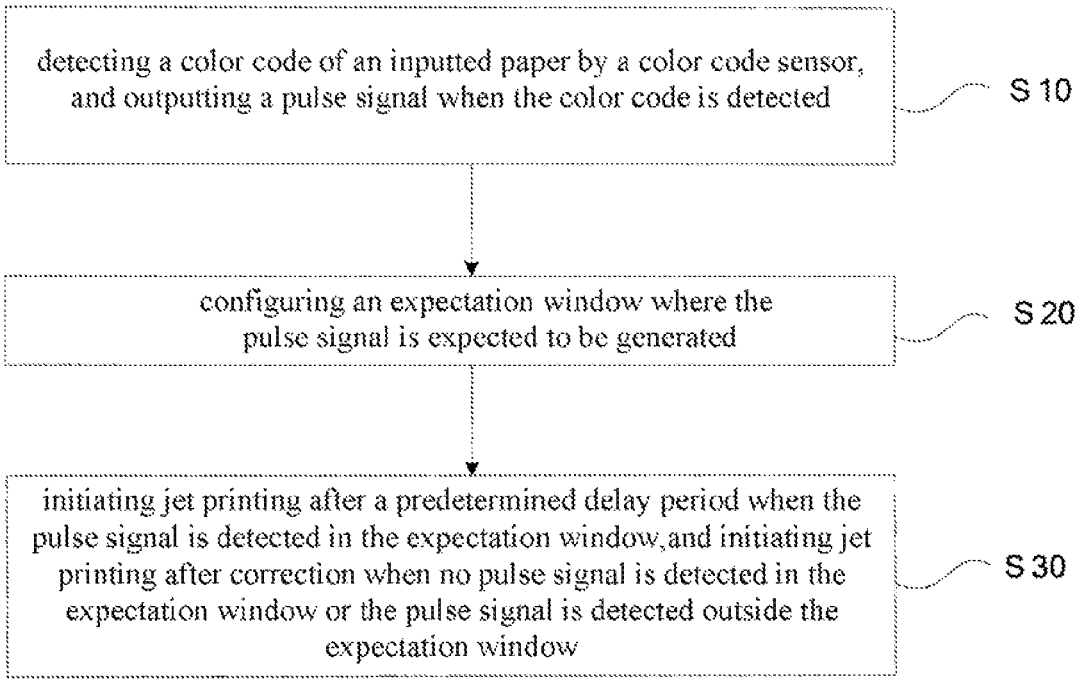
FIG. 1 is a flowchart illustrating a method for controlling positions of jet printing according to an embodiment of the present application.

FIG. 1 is a flowchart illustrating a method for controlling positions of jet printing according to an embodiment of the present application. The method comprises the following steps.

Step S10: detecting a color code of an inputted paper by a color code sensor, and outputting a pulse signal when the color code is detected.

Step S20: configuring an expectation window where a pulse signal is expected to be generated.

Step S30: initiating jet printing after a predetermined delay period when the pulse signal is detected in the expectation window; and initiating jet printing after correction when no pulse signal is detected in the expectation window or the pulse signal is detected outside the expectation window.

In the prior art, in both the high level control method based on software or the simple control method based on hardware, positions of jet printing are controlled depending on pulse signals of color code detection. Thus, when the pulse signals are interfered or a color code is not detected, there would be false printing or missed printing so that some defective products would be produced. According to the method for controlling positions of jet printing consistent with this embodiment, positions of jet printing are not controlled only based on pulse signals of color code detection. Instead, an expectation window where a pulse signal is expected to be generated is predefined. When no pulse signal is detected in the expectation window or the pulse signal is detected outside the expectation window, jet printing is initiated after performing correction. Therefore, when the pulse signals are interfered or a color code is not detected, the problem of false printing or missed printing in the prior art may be solved.

Step S20 may comprise: configuring a scale of an average spacing of the color codes on a time axis as the center of the expectation window, and configuring positions which are separated by an error tolerance from the center as left and right boundaries of the expectation window.

Since the scale of an average spacing of the color codes on a time axis is the mathematical expectation of the pulse signals generated by detecting the color codes, the scale may be configured as the center of the expectation window in this embodiment so that the pulse signal hit rate is high. In addition, considering the errors that may occur when the papers are inputted, a certain error tolerance may be allowed in this embodiment. Therefore, this embodiment can be easily implemented and may correct within the error tolerance the interference to color code signals and the missed color codes.

Step S20 may further comprise: before receiving a predetermined number of pulse signals, configuring in real time the average spacing of the color codes as t/n; wherein t is the duration from detecting the first pulse signal to receiving a current pulse signal, and n=(the number of received pulse signals)−1, and wherein the duration is measured by the number of pulses generated by an incremental encoder for synchronizing the color code sensor. In this embodiment, a solution to calculate the average spacing of color codes is provided.

In Step S30, initiating jet printing after correction may comprise: initiating jet printing after delaying a predetermined period from the center of the expectation window when no pulse signal is detected in the expectation window. In one embodiment, if no pulse signal is detected in the expectation window, it is considered that a color code has failed to be detected. Then, jet printing may be initiated after delaying the predetermined period from the center of the expectation window. Therefore, when a color code is not detected, the problem of missed printing in the prior art may be solved.

The method for controlling positions of jet printing may further comprise stopping the printing and issuing an alarm when no pulse signal is detected in a predetermined number of the continuous expectation windows. In one embodiment, when no pulse signal is detected in a predetermined number of the continuous expectation windows, a fault may have occurred in the jet printer. The system may stop the printing in time and issue an alarm, so as to control the loss and alert users for system repairs.

Initiating jet printing after correction may further comprise: determining a pulse signal to be invalid when the pulse signal is detected outside the expectation window. In one embodiment, when a pulse signal is detected outside the expectation window, the pulse signal may be an interference signal, and then the signal may be ignored. Therefore, when a color code signal is interfered, the problem of false printing in the prior art may be solved.

The method for controlling positions of jet printing may further comprise: during the process of configuring the expectation window where a pulse signal is expected to be generated, initiating jet printing after a predetermined delay period when a pulse signal is detected, calculating in real time the average spacing of the detected color codes, and issuing an alarm if the calculated average spacing is larger than a predetermined value. Since it takes time to configure the expectation window, no correction is performed during the process of configuring the expectation window, thereby ensuring the real-time printing during this time period.

Figure 2:
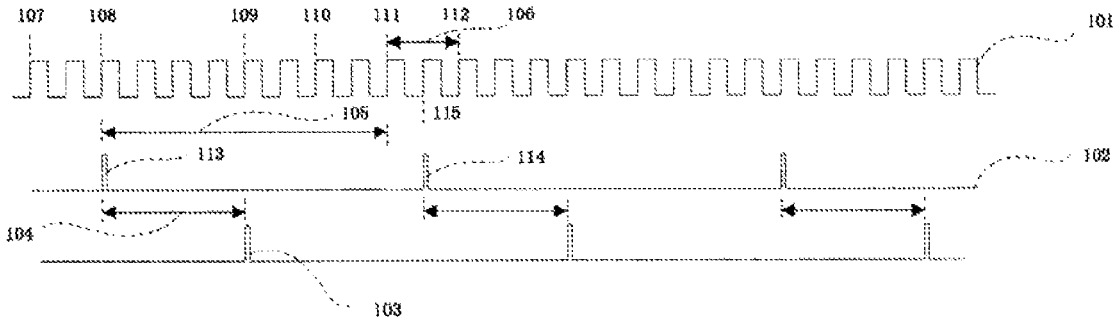
FIG. 2 is a schematic diagram of pulse signals in a normal state according to an embodiment of the present application.
Figure 3:
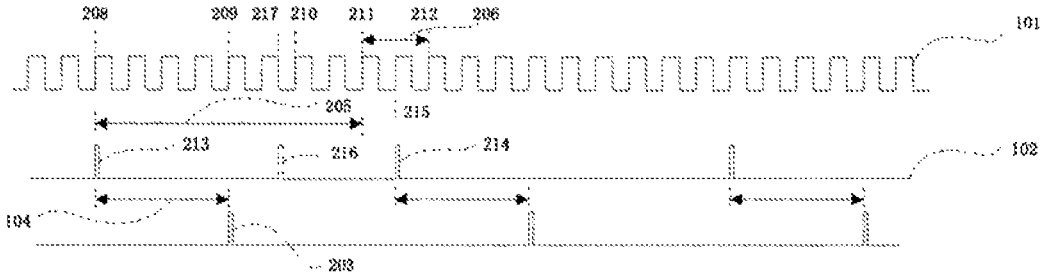
FIG. 3 is a schematic diagram of pulse signals when a signal is interfered according to an embodiment of the present application.
Figure 4:
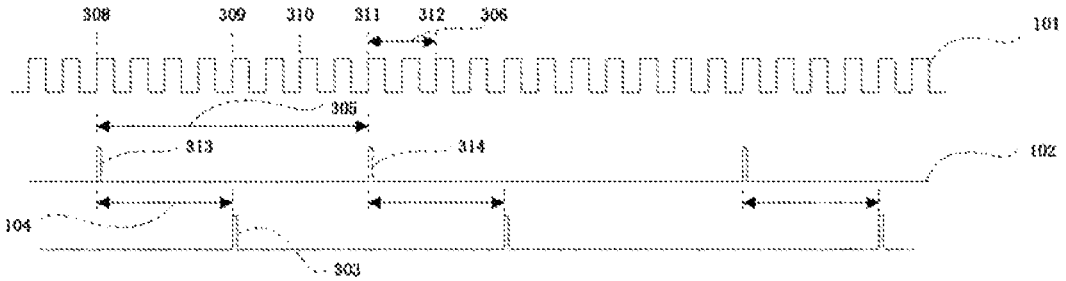
FIG. 4 is a schematic diagram of pulse signals when a color code signal is not detected according to an embodiment of the present application.

FIG. 2 is a schematic sequence diagram of signal pulses in a normal state according to an embodiment of the present application; FIG. 3 is a schematic sequence diagram of pulses by an interference to signals according to an embodiment of the present application; and FIG. 4 is a schematic sequence diagram of pulses with a color code signal missed to be detected according to an embodiment of the present application. Embodiments consistent with the present application will be described now with reference to FIGS. 2-4.

First, the operating parameters for hardware are configured, including: the number N1 of encoder pulses between a color code signal and initiation of printing; the estimated number N2 of encoder pulses between two color code signals; the statistics number N3 during calculating the average spacing of color code signals; the average spacing N4 of color codes, calculated in real time according to the statistics number N3; tolerance N5 of position errors of color code signals, i.e., the percentage of the error range to the color code spacing; the number ±N6 of encoder pulses within the tolerance of the current color code position error, calculated according to the color code spacing N4 calculated in real time and the tolerance N5 of position errors of color code signals; and the number N7 of virtual color code signals that can be continuously output when no actual color code signals are detected continuously.

The first detected encoder pulse signal is the positional origin and the unit of length is the pulse of the incremental encoder. During the early stage of printing, the average spacing of color codes is counted and calculated, the printing is delayed to initiate for the color codes, and no correction is performed for the color code signals. The early stage of printing is the period when the number of the detected color codes is smaller than the configured statistics number N3 during calculating the average spacing of color code signals (namely, the period when the expectation window where the pulse signal is expected to be generated is configured, FIGS. 2-4 does not show the early stage of printing). During this period, if the difference between the calculated value N4 of average spacing of color codes and the configured estimate N2 of spacing of color code signals is too large, the printing system may set an alarm to indicate a problem.

During the printing, according to the configured parameters and the parameters calculated in real time, a color code signal detection window (namely, the expectation window)

may be established. In addition, only the color code signal detected within the window may be considered a valid signal, and color code signals detected in other positions are considered invalid signals.

When a valid color code signal is detected within the window, N1 encoder pulses are delayed to output a printing initiation signal. If a color code signal is detected outside the window, it may be considered to be an interference signal and may be ignored. If no valid color code signal is detected within the window, a virtual color code signal may be generated according to the previously calculated value, namely, (N1-N6) encoder pulses are delayed to output the printing initiation signal. The center of the window may be the position of the current virtual color code. If the number N7 of color code signals have failed to be detected continuously, it may stop the printing and set off an alarm.

In addition, the following information may be recorded during the whole printing so as to analyze the system stability, including: the original position of the color code signal detected by the color code sensor (including the position of the detected interference signal); the position of the virtual color code signal which is needed to be generated due to a missed detection of a color code sensor; and the position of printing initiation signal which is generated according to the color code signal and the configuration of delaying.

As shown in FIG. 2, in one embodiment, when papers are fed with a rubber roller continuously, the incremental encoder may be brought into rotation and outputs encoder pulse signals 101. The first encoder pulse detected in the system may be used as the origination position 107. The color code sensor may be fixed above the continuous papers so as to detect color blocks printed on the continuous papers. When the color code sensor detects a color block, it may output a pulse signal. With the movement of the papers, the color code sensor may output a series of regular pulse signals 102. During the early stage of printing, i.e., when the number of color code pulse signals output by the color code sensor is smaller than N3, the average spacing of color codes N4 is calculated in real time, and the printing is initiated after a delay 104 without correction for the color code signals.

During normal printing, a color code output pulse signal 113 may be detected at a position 108 and the average spacing N4 of color codes at the position 108 is calculated in real time to be 105. According to the average spacing 105 of color codes calculated in real time and the tolerance N5 of position errors of color code signals, the number ±N6 of encoder pulses within the tolerance of position errors of the current color code may be calculated to be 106. According to the number N1 of encoder pulses between the practical color code signal configured in (1) and the initiation of printing (i.e., 104), a plurality of encoder pulses 104 may be delayed from the position 108 and a pulse signal of printing initiation 103 may be generated at the position 109. From the current color code position 108, it may be delayed for 105, namely, from the position 111, a window is established, whose size is 106 (namely, from the position 110 to the position 112). At the position 115 within the range, a next color code output pulse signal 114 may be detected and adopted.

As shown in FIG. 3, during the printing with interference, a color code output pulse signal 213 may be detected at the position 208 and the average spacing N4 of color codes from the position 208 is calculated in real time to be 205. According to the average spacing 205 of color codes calculated in real time and the tolerance N5 of position errors of color code signals, the number ±N6 of encoder pulses within the tolerance of position errors of the current color code may be calculated to be 206. According to the number N1 of encoder pulses between the configured practical color code signal and the initiation of printing (i.e., 104), a plurality of encoder pulses 104 may be delayed from the position 208 and a pulse signal of printing initiation 203 may be generated at the position 209. From the current color code position 208, it may be delayed for 205, namely, a window may be established from the position 211, whose size is 206 (namely, from the position 210 to the position 212). At the position 217, a color code signal 216 may be detected. Since the color code signal 216 is not between the position 210 and the position 212, the color code signal 216 may be an interference signal and may not be adopted. At the position 215 between the position 210 and the position 212, a color code pulse signal 214 may be detected and adopted.

As shown in FIG. 4, during the printing with missed printing, a color code output pulse signal 313 may be detected at the position 308 and the average spacing N4 of color codes from the position 308 may be calculated in real time to be 305. According to the average spacing 305 of color codes calculated in real time and the tolerance N5 of position errors of color code signals, the number ±N6 of encoder pulses within the tolerance of position errors of the current color code, may be calculated to be 306. According to the number N1 of encoder pulses between the configured practical color code signal and the initiation of printing (i.e., 104), a plurality of encoder pulses 104 may be delayed from the position 308 and a pulse signal 303 of printing initiation may be generated at the position 309. From the current color code position 308, it may be delayed for 305, namely, at the position 311, a window may be established, whose size is 306 (namely, from the position 310 to the position 312). No pulse signals may be detected within this range and it may be delayed for 305 from the position 308 of the current color code, namely, at the position 311, a virtual color code pulse signal 314 may be generated to be adopted. If N5 color code signals are missed to be detected continuously, it may stop the printing and set off an alarm.

During the printing, in these examples, the position information which is needed to be recorded may include: the position 108, the position 115, the position 208, the position 215, the position 308, the position 217, the position 314, the position 103, the position 203, ant the position 303, etc.

In the embodiments consistent with the present application, based on the correction for color code signals, positions in the high speed jet printing can be accurately controlled. With the use of the above method, interference signals to the color code sensor can be filtered and correct color code sensor signals can be protected and adopted. Virtual color code signals can be generated so that the situation that a color code has failed to be detected due to the problems of color blocks or installation can be corrected. The signals such as the positions of the detected color code signals and the positions of the generated printing initiation signals can be stored and analyzed so that the stability of the system and the accuracy of positions of jet printing may be improved.

Figure 5:
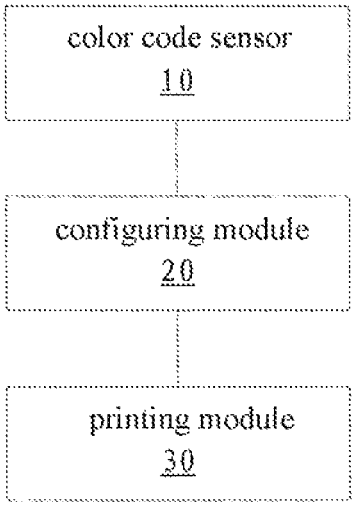
FIG. 5 is a schematic diagram illustrating a device for controlling positions of jet printing according to an embodiment of the present application.

FIG. 5 is a schematic diagram illustrating a device for controlling positions of jet printing according to an embodiment of the present application. The device may comprise: a color code sensor 10 for detecting color codes of inputted papers and outputting a pulse signal when a color code is detected; a configuring module 20 for configuring an expectation window where the pulse signal is expected to be generated; and a printing module 30 for initiating jet printing after a predetermined delay period when a pulse signal is detected in the expectation window and for initiating jet printing after correction when no pulse signal is detected in the expectation window or a pulse signal is detected outside the expectation window.

With the use of the device, the problem of false printing or missed printing in the prior art may be solved.

The printing module 30 may further comprise: a miss-detection module for initiating jet printing after a predetermined delay period from the center of the expectation window when no pulse signal is detected in the expectation window.

In this embodiment, when a color code has failed to be detected, the problem of missed printing in the prior art may be solved.

Additionally, the printing module 30 may comprise: a false-detection module for determining a pulse signal to be invalid when the pulse signal is detected outside the expectation window.

In this embodiment, when a color code signal is interfered, the problem of false printing in the prior art may be solved.

From the above description, it can be observed that in the above embodiments of the present application, the positions of jet printing of patterns can be controlled exactly so as to greatly improve the practicability of the system, reduce the defective rate in the process of jet printing and improve the production efficiency.

It will be readily apparent to those skilled in the art that the modules or steps of the present application may be implemented with a common computing device. In addition, the modules or steps of the present application can be concentrated or run in a single computing device or distributed in a network composed of multiple computing devices. Optionally, the modules or steps may be achieved by using codes of the executable program, so that they can be stored in the storage medium, or the plurality of the modules or steps can be fabricated into an individual integrated circuit module. Therefore, the present application is not limited to any particular hardware, software or combination thereof.

The foregoing is only preferred embodiments of the present application, and it is not intended to limit the present application. Moreover, it will be apparent to those skilled in the art that various modifications and variations can be made to the present application. Thus, any modifications, equivalent substitutions, improvements etc. within the spirit and principle of the present application should be included within the scope of protection of the application.

What is claimed is:

1. A method for controlling positions of jet printing, comprising:

detecting a color code of an inputted paper by a color code sensor, and outputting a pulse signal when the color code is detected;

configuring an expectation window where the pulse signal is expected to be generated;

initiating jet printing after a predetermined delay period when the pulse signal is detected in the expectation window and initiating jet printing after correction when no pulse signal is detected in the expectation window or the pulse signal is detected outside the expectation window, wherein the step of configuring an expectation window where the pulse signal is expected to be generated comprises configuring a scale of an average spacing of color codes on a time axis as a center of the expectation window, and configuring positions which are separated by an error tolerance from the center as left and right boundaries of the expectation window.

2. The method according to claim 1, wherein the step of configuring an expectation window where the pulse signal is expected to be generated further comprises: before receiving a predetermined number of pulse signals, configuring in real time the average spacing of the color codes as t/n wherein t is a duration from detecting a first pulse signal to receiving a current pulse signal, n=(the number of received pulse signals)−1, and wherein the unit of the duration is the number of pulses of an incremental encoder for synchronizing the color code sensor.

3. The method according to claim 1, wherein the step of initiating jet printing after correction comprises:

initiating the jet printing after the predetermined delay period from the center of the expectation window when no pulse signal is detected in the expectation window.

4. The method according to claim 3, further comprising:

stopping the printing and alarming when no pulse signal is detected in a predetermined number of continuous expectation windows.

5. The method according to claim 1, wherein the step of initiating jet printing after correction comprises:

determining a pulse signal to be invalid when the pulse signal is detected outside the expectation window.

6. The method according to claim 1, further comprising:

during configuring the expectation window where a pulse signal is expected to be generated, initiating the jet printing after the predetermined delay period when the pulse signal is detected; and calculating in real time an average spacing of the detected color codes, and alarming if the average spacing calculated out is larger than a predetermined value.

7. A device for controlling positions of jet printing, comprising:

a color code sensor for detecting color codes of inputted papers and outputting a pulse signal when a color code is detected;

a configuring module for configuring an expectation window where the pulse signal is expected to be generated, wherein configuring the expectation window comprises at least one of configuring a scale of an average spacing of color codes on a time axis as a center of the expectation window, and configuring positions which are separated by an error tolerance from the center as left and right boundaries of the expectation window; and a printing module for initiating jet printing after a predetermined delay period when a pulse signal is detected in the expectation window and for initiating the jet printing after correction when no pulse signal is detected in the expectation window or a pulse signal is detected outside the expectation window.

8. The device according to claim 7, wherein the printing module comprises:

a miss-detection module for initiating the jet printing after the predetermined delay period from the center of the expectation window when no pulse signal is detected in the expectation window.

9. The device according to claim 7, wherein the printing module comprises:

a false-detection module for determining a pulse signal to be invalid when the pulse signal is detected outside the expectation window.

* * * * *